US006588979B1

(12) United States Patent
Pasij

(10) Patent No.: US 6,588,979 B1
(45) Date of Patent: Jul. 8, 2003

(54) FLOOD FENCE

(76) Inventor: Peter Pasij, 725 Indiana St., Elmhurst, IL (US) 60126

( * ) Notice: Subject to any disclaimer, the term of this patent is extended or adjusted under 35 U.S.C. 154(b) by 0 days.

(21) Appl. No.: 10/224,409

(22) Filed: Aug. 21, 2002

(51) Int. Cl.[7] ..... E02B 7/08

(52) U.S. Cl. ..... 405/114; 405/15; 405/107; 405/31; 256/31; 52/102; 52/169.14

(58) Field of Search ..... 405/15, 16, 31, 405/33, 107, 112, 114; 256/24, 31; 52/102, 169.14

(56) References Cited

U.S. PATENT DOCUMENTS 3,100,953 A * 8/1963 Johnson ..... 52/563
3,342,033 A * 9/1967 Crouch et al. ..... 405/116
3,385,567 A * 5/1968 Case et al. ..... 256/24
3,465,530 A * 9/1969 Renfro ..... 405/110
3,477,751 A * 11/1969 Bos ..... 52/698
3,520,082 A * 7/1970 Smith ..... 47/33
3,902,702 A * 9/1975 Kinnaman ..... 256/19
4,175,888 A * 11/1979 Ijima ..... 405/31
4,252,461 A * 2/1981 Colamussi et al. ..... 405/115
4,375,929 A * 3/1983 Clark ..... 405/114
4,582,451 A * 4/1986 Hollander, Jr. ..... 405/105
5,048,241 A * 9/1991 Gavin, Jr. ..... 52/102
5,114,270 A * 5/1992 Riddle ..... 405/15
5,393,169 A * 2/1995 Creter ..... 405/25
5,456,045 A * 10/1995 Bradley et al. ..... 47/33
5,511,902 A * 4/1996 Center ..... 405/16
5,921,709 A * 7/1999 Baum et al. ..... 405/16
5,967,701 A * 10/1999 Berkley et al. ..... 405/281
6,026,610 A * 2/2000 Northrop et al. ..... 47/33
6,216,410 B1 * 4/2001 Haberman ..... 52/591.1

* cited by examiner

*Primary Examiner*—J. J. Swann
*Assistant Examiner*—Katherine Mitchell
(74) *Attorney, Agent, or Firm*—Kajane McManus

(57) ABSTRACT

A flood fence wherein a plurality of deflectors or sections are placed end to end and into the soil in upright positions. The sections have a saw tooth bottom edge and downwardly extending uprights that engage within a soil substrate to thereby protect the soil on one side of the fence from water flow against the other side. The areas of joining between adjacent sections also include a support and secondary barriers to minimize seepage therepast as well as to assure that the sections remain engaged.

6 Claims, 2 Drawing Sheets

FLOOD FENCE

BACKGROUND OF THE INVENTION

1. Field of the Invention

The present invention relates to flood fences or water deflectors and more particularly to a fence comprised of one or more substantially identical sections which are engageable to form a barrier or fence against flooding.

2. Prior Art

Heretofore various deflectors or flood fences have been proposed.

However, none have included supports for areas of engagement between sections thereof nor secondary barriers against water flow through the areas of engagement between the sections.

SUMMARY OF THE INVENTION

A primary object of the invention is to prevent flood water from entering an area surrounding a dwelling or basement thereof. The flood fence may be set in the lawn around the building so that water flow against a side of the fence facing away from the building is thwarted from reaching the building.

The flood fence is equally effective for a garden to prevent soil and fertilizer from being washed away from and around young vegetable plants.

Still another object of the invention would be to divert the water away from a plant bed.

The flood fence will also eliminate the use of unsightly ditches or furrows.

The flood fence may be made of any suitable material, such as sheet aluminum, a plastic material, galvanized sheet metal, wood; etc. The flood fence may also be made to any desired dimensions.

BRIEF DESCRIPTION OF THE DRAWINGS

Other objects and advantages of this invention will become apparent during the course of the following description taken in connection with the accompanying drawing, forming a part of this specification and in which drawings.

DESCRIPTION OF THE PREFERRED EMBODIMENTS

Figure 1:
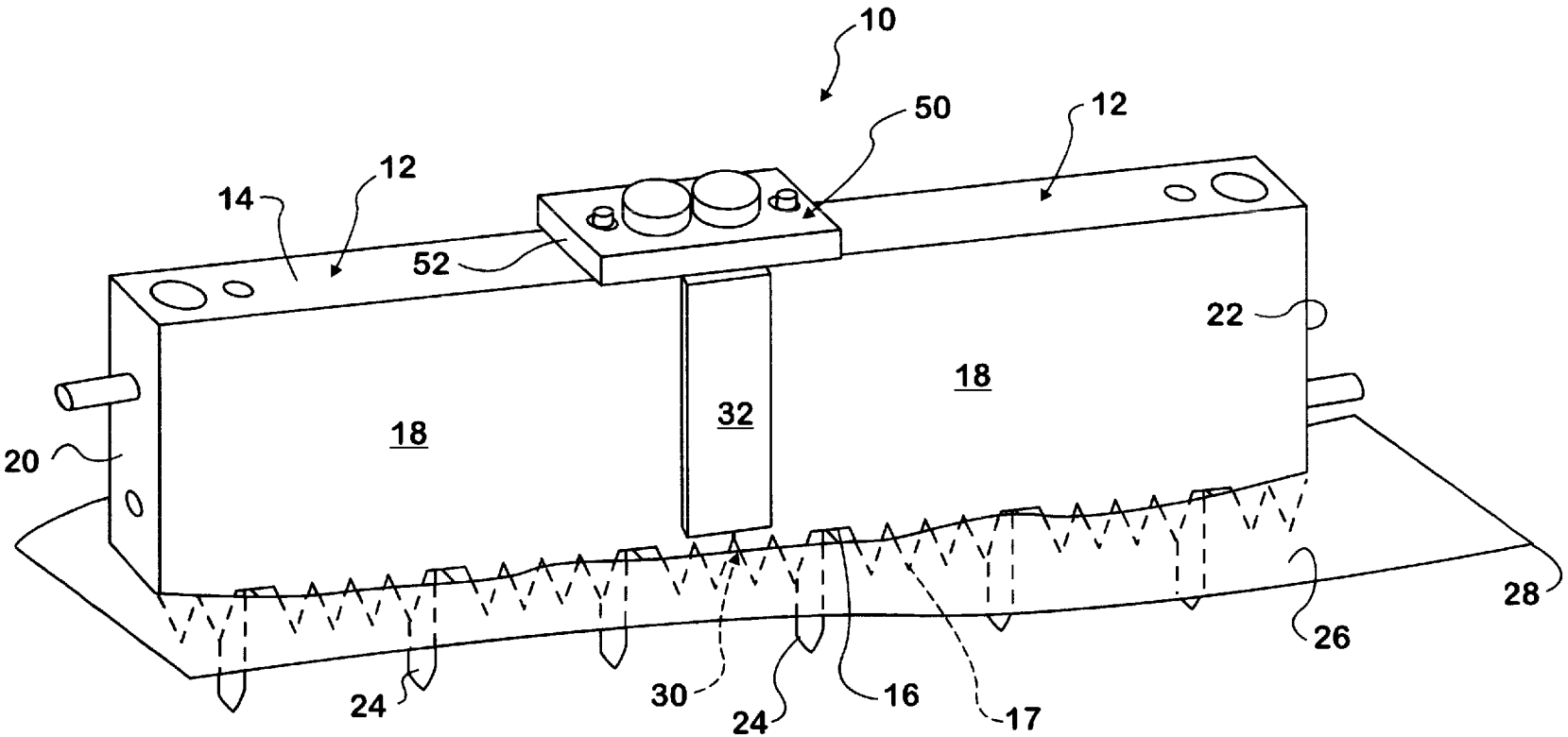
FIG. 1 is a perspective view of a portion of the flood fence of the present invention showing two deflectors or sections thereof engaged together for use.
Figure 5:
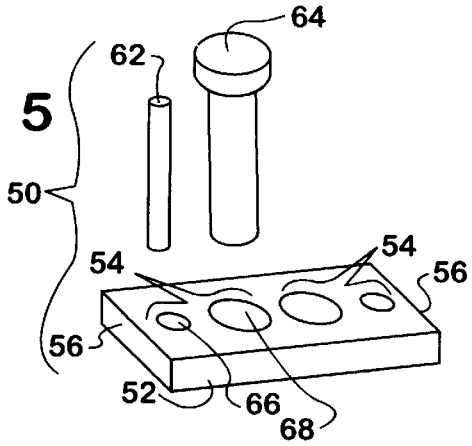
FIG. 5 is an exploded perspective view of a support for each area of engagement between sections of the fence.
Figure 4:
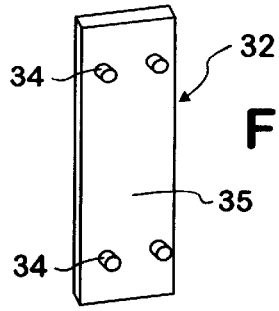
FIG. 4 is a perspective view of a secondary barrier of the flood fence.
Figure 3:
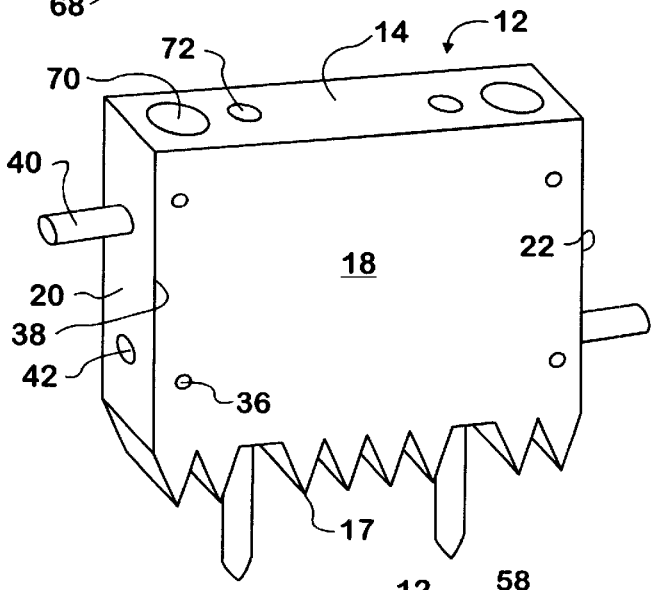
FIG. 3 is a perspective view of a section of the flood fence which is sized differently than that of FIG. 2.
Figure 2:
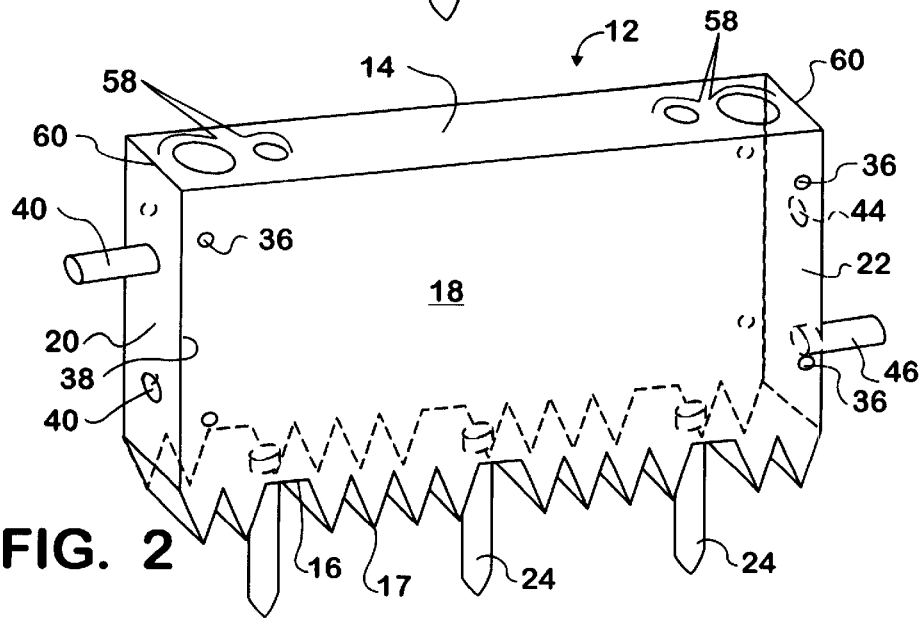
FIG. 2 is a perspective view of a section of the flood fence.

Referring now to the drawings there is illustrated therein a flood fence 10 made in accordance with the teachings of the present invention and generally identified by reference numeral 10.

As shown, the fence 10 comprises a plurality sections 12 which are engageable end to end to accommodate any required length for such fence 10.

Each section 12 is seen to be a block like structure 12 having a top surface 14, a bottom surface 16 having a sawtooth configuration 17 therealong, planar side walls 18 and end walls 20 and 22 respectively.

The bottom surface 16 of each section 12 is also seen to incorporate a plurality of intermittent sharp pegs 24, the pegs 24, as well as the sawtooth configuration 17 of each section 12 being forced beneath a top surface 26 of an underlying support surface 28, such as soil.

It will be understood that though the sections 12 are firmly implanted into the support surface 28, there is still a potential for seepage of water through an area at 30 between adjacent, abutting sections 12. For this purpose, secondary barriers 32 are provided which engage each adjacent section and extend across the area 30 therebetween along each side of the adjacent sections 12. Engagement between the secondary barriers 32 and the sections 12 is created by the provision of engagement pins 34 on the backside 35 of each secondary barriers 32 which correspond to bores 36 provided on each side wall 18 toward end edges 38 thereof, the pins 34 aligning with the bores 36 and being maintained therein in a friction fit manner, in a preferred embodiment.

Further, it will be seen that alignment between adjacent sections 12 is ensured by providing an upper pin 40 and a lower bore 42 in each end wall 20 while providing an upper bore 44 and a lower pin 46 in each end wall 22 such that, when end walls 20 and 22 of adjacent sections 12 are brought together, the pin 40, 46 on one end wall 20, 22 engages the bore 42, 44 on the adjacent end wall 22, 20, providing lateral stability of the joined sections 12.

Finally, to further ensure that there is no separation between adjacent sections 12, a support 50 is engaged over and to the top surface 14 of adjacent sections 12, across the area 30 therebetween.

The support 50 straddles the area 30 between the sections 12 along the top surface 14 of the sections 12. The support 50 comprises a planar base 52 having two pairs of bores 54 therein, one pair of bores 54 lying near each end 56 of the support structure 50. The top surface 14 of each section 12 also has a pair of cooperating bores 58 therein toward each end 60 thereof such that a connector 62, 64 can be passed through a respective bore 66, 68 in the support 50 and into a corresponding, underlying bore 70, 72 in the top surface 14 of sections 12 adjacent one another to keep the support 50 from shifting or separating about the area 30 of engagement therebetween. In the preferred embodiment illustrated, one bore 68, 70 of each pair of bores 54, 58 is larger in diameter than the other 66, 72 to accept a connector 64 of larger diameter, though this should not be construed as limiting.

The support 50 is typically engaged and connected once the sections 12 have been positioned as desired and then the secondary barriers 32 are engaged to produce the flood fence 10 which is not only supported but virtually eliminates any seepage of water between the engaged sections 12.

As described above, the flood fence 10 provide a number of advantages, some of which have been described above and others of which are inherent in the invention. Also modifications may be proposed to the teachings herein without departing from the scope of the invention. Accordingly the scope of the invention is only to be limited as necessitated by the accompanying claims.

I claim:

1. A flood fence comprising a plurality of engageable sections, each section having a pair of substantantially parallel longitudinal sides and a pair of a substantially parallel ends, said ends substantially perpendicularly spanning the longitudinal sides such that a substantially rectangular cross section is formed, each section further comprising a sawtooth bottom edge and downwardly extending pegs partially buried in a support surface for the fence and being mechanically connected laterally end to end in series to divert water flowing against one side of the fence away from the other side thereof, the areas of engagement between engaged adjacent sections having secondary barriers spanning each area of engagement and engaged to each side thereof and support being engaged to each of the adjacent sections and across the area of engagement therebetween to maintain the sections from separating when water flows thereagainst.

2. The fence of claim 1 wherein the sections are of any desired dimension.

3. The fence of claim 1 being made of any material suitable for deflection of water flow thereagainst.

4. The fence of claim 1 wherein any number of sections can be engaged to create the fence.

5. The fence of claim 1 wherein the sections include side walls, each side wall having two ends, and each secondary barrier includes engagement pins on a backside thereof which frictionally engage within bores in the side walls of each section, the bores being positioned toward each end of each side wall.

6. The fence of claim 1 wherein each support comprises a base having two pairs of bores therein, one pair of bores lying near each end of the support, the sections also having bores therein underlying the bores in the base, and the support further including connectors which engage through the bores in the support and into the bores in the sections.

* * * * *